US005306085A

United States Patent [19]

Kobayashi

[11] Patent Number: 5,306,085

[45] Date of Patent: Apr. 26, 1994

[54] MULTIPLEX WRITING IMPLEMENT WITH ERASER

[75] Inventor: Seiichi Kobayashi, Yokohama, Japan

[73] Assignee: Mitsubishi Pencil Kabushiki Kaisha, Tokyo, Japan

[21] Appl. No.: 972,509

[22] Filed: Nov. 6, 1992

[30] Foreign Application Priority Data

Dec. 3, 1991 [JP] Japan ..... 3-107265[U]
Dec. 3, 1991 [JP] Japan ..... 3-107268[U]

[51] Int. Cl.[5] ..... B43K 29/02; B43K 24/14

[52] U.S. Cl. ..... 401/29; 401/32; 401/33; 401/52; 15/429

[58] Field of Search ..... 401/29, 30, 32, 33, 401/52; 15/429

[56] References Cited

U.S. PATENT DOCUMENTS

| | | | |
|---|---|---|---|
| 1,104,514 | 7/1914 | Kilstrom | 15/429 |
| 1,662,474 | 3/1928 | Randall | 15/429 |
| 4,202,641 | 5/1980 | Tomura | 401/33 X |
| 4,227,822 | 10/1980 | Kokubu | 401/33 X |
| 4,283,151 | 8/1981 | Sekiguchi | 401/33 |
| 4,290,707 | 9/1981 | Ariga | 401/33 X |
| 4,904,101 | 2/1990 | Petterson | 401/52 |
| 5,056,947 | 10/1991 | Kubota et al. | 401/33 X |
| 5,062,727 | 11/1991 | Kageyama et al. | 401/52 |

FOREIGN PATENT DOCUMENTS

| | | | |
|---|---|---|---|
| 64-3491 | 10/1989 | Japan . | |
| 2-28077 | 8/1990 | Japan . | |
| 0292098 | 12/1990 | Japan | 401/52 |

*Primary Examiner*—Steven A. Bratlie
*Attorney, Agent, or Firm*—Darby & Darby

[57] ABSTRACT

A multiplex writing implement comprises a plurality of writing elements, at least one which is a mechanical pencil writing element, which can be selectively projected and retracted from the front opening of the front barrel section by rotating a middle barrel section relative to the front barrel section. An eraser can be extended by rotation of a cap relative to the middle barrel section. The implement includes the following resin molded components, namely, a guide cylinder, front barrel section, cylindrical cam, middle barrel section, cap, and an eraser guide sleeve. The front half portion of the guide cylinder is fixed to the front barrel section and is attached rotatably in its rear half portion to the middle barrel section. The guide cylinder contains a plurality of writing elements fit in respective grooves and movable axially. The cylindrical cam is attached rotatably into the rear end of the guide cylinder, and is disposed in the middle barrel section, locked from relative turning. At the rear end of the cylindrical cam, projecting from the middle barrel section, the eraser guide sleeve is integrally joined. The cap, with a spiral slot formed thereinside, is rotatably attached. Inside the cap is an eraser holder, with an eraser that is locked against rotation and has a projection engaging the spiral slot.

4 Claims, 5 Drawing Sheets

MULTIPLEX WRITING IMPLEMENT WITH ERASER

BACKGROUND OF THE INVENTION

1. Field of the Invention

The present invention relates to a multiplex writing implement, and more particularly to a multiplex writing implement comprising a plurality of writing elements, at least one of which is a mechanical pencil, and whose writing tips can be alternately projected and retracted from the top opening of the front barrel section thereof; and an eraser which can be projected and retracted from the rear end of the cap thereof.

2. Description of the Related Art

Various kinds of writing implements have been proposed and provided which include plural writing elements, at least one of which is a mechanical pencil, and whose writing tips can be selectively projected and retracted from a top opening of a front barrel, namely a multiplex writing implement.

The present applicant has made several proposals relating to the aforesaid multiplex implement.

Of these proposals, there is disclosed a Japanese Utility Model Laid-Open Publication No. sho-64-3419 (published in 1989), which will be referred to as a first prior art example hereinafter. A multiplex writing implement in accordance with the first prior art example includes two writing elements each having a sliding piece at the rear end thereof. A guide cylinder having guide grooves for guiding these writing elements is provided securely fixed to a front barrel section of the device to contain and cover these writing elements. The implement is also provided with a cylindrical cam having at its front end a slanted cam surface which comes in sliding contact with the aforesaid sliding pieces, and a knocker at the rear ends thereof. The cylindrical cam can move in an axial direction with respect to a cap and rotate integrally with the cap in a circular direction. With this arrangement, the two writing elements can be selectively projected and retracted from the top or front opening of the front barrel section by rotation of the cap with respect to the front barrel.

The implement according to the first prior art example, however has a drawback, that is, it is difficult to take out the knock cover when an eraser is to be used.

Another proposal is disclosed by Japanese Utility Model Laid-Open No. sho-60-120889 (published in 1985) which will be referred to as a second prior art example herein. A multiplex writing implement according to the second prior art example, is structured such that a crown-shaped member projected out from the rear end of a cap is rotated to allow an eraser to project and retract.

The second prior art example has an advantage in that the drawback of the first prior art example, stated above, can be eliminated, but the implement of the second prior art example requires numerous metal components in various parts, and each component has a complicated structure, resulting in high cost.

Moreover, in the multiplex writing implement of the second prior art example, the crown-shaped member projected out from the cap is hard to hold with fingers due to its shortness, thus giving rise to difficulty in projecting and retracting the eraser.

SUMMARY OF THE INVENTION

The present invention has been accomplished after consideration of what is discussed above, and it is therefore an object of the present invention to provide a multiplex writing implement in which advancement and retraction of an eraser can be carried out readily, and to provide an implement which has a simple structure and is made of a resin material as a whole, reducing the cost of manufacture.

The above object of the present invention can be achieved by providing a multiplex writing implement comprising:

a front barrel section made of a resin;

a middle barrel section, made of a resin, and disposed coaxially with and in the rear of the front barrel section;

a plurality of writing elements, at least one of which is a mechanical pencil, and each of which is provided with a sliding piece at the rear end thereof;

a guide member, made of a resin material, fixed to the front barrel section for fitting each of the plural writing elements in a corresponding guide groove arranged in the axial direction so that the writing elements can be moved in the axial direction;

a cylindrical cam member having a slanted cam surface at the front side thereof, and being positioned rotatably on the periphery of a guide cylinder, the slanted cam surface having a circular shape and abutting against the sliding pieces;

an eraser holder having a projection integrally provided on the peripheral side thereof, for fixing an eraser at a rear opening;

an eraser guide member fixedly disposed at the rear end of the cylindrical cam member so as to move integrally with the cylindrical cam member, and having a slit along the axial direction into which the projection of the eraser holder is slidably fit, for allowing the eraser holder to slide thereinside; and an eraser projecting and retracting means for projecting and retracting the eraser from the rear end of the eraser guide member by moving the eraser holder inside the eraser guide member;

the multiplex writing implement being operated such that the sliding pieces are made to abut against the slanted cam surface of the cylindrical cam, and are moved forward and backward alternately by rotation of the cylindrical cam member with respect to the front barrel section so that each writing tip of the writing element is selectively projected and retracted from the top opening of the front barrel section; and when the mechanical pencil writing element is selectively engaged, the pencil lead can be discharged by knocking (depressing) the rear end of the eraser guide member against the middle barrel section, and the eraser can be projected and retracted from the rear end of the multiplex writing implement by handling the eraser projecting and retracting means.

In accordance with a preferred embodiment of the present invention, the guide member is fixed against rotation and locked in the axial direction against the middle barrel section;

the middle barrel section is locked, in the turning direction, against the cylindrical cam member;

the cylindrical cam member is integrally joined with the eraser guide member such that the front end portion of the eraser guide member is inserted into the rear end of the cylindrical cam member;

the eraser guide member carries on its circumference a cap member which is made of a resin material and the inner wall thereof is formed with a spiral slot, such that the cap member is rotatable and locked in the axial direction; and the eraser projecting and retracting means comprises a slit disposed in the eraser guide member, a spiral slot disposed on the inner wall of the cap member, and a projection which is fit in the spiral slot through the slit, and the eraser is projected and retracted from the rear end of the eraser guide member by rotation of the cap member against the middle barrel section.

In accordance with another preferred embodiment of the present invention, the eraser guide member has a crown portion at its rear end which has a larger diameter than the center portion thereof;

the cylindrical member has a collar portion extending outward on the outer circumference at the rear end thereof; and the cap member is arranged rotatably and locked in the axial direction by the crown portion and the collar portion, and the front end portion thereof covers the guide member and the rear end of the middle barrel section.

In accordance with further preferred embodiments of the present invention, a middle barrel section is integrated with the guide member.

In accordance with a still further embodiment of the present invention, the middle barrel section is integral with the guide member, and the eraser guide member and eraser holder have eraser engaging means for engaging the eraser holder at a desired position.

In accordance with still another embodiment of the present invention, the eraser engaging means comprises the slit, projected and recessed portions disposed along the slit, and a projection of the eraser holder. The projection is fit into the slit to be projected beyond the outer face of the eraser guide member, so that the projection is able to engage and disengage with the recessed portions, whereby the eraser is projected and retracted from the rear end of the eraser guide member.

In accordance with still another embodiment of the present invention, the eraser guide member is formed such that the front end portion thereof covers the guide member and the rear end of the middle barrel section.

The present invention is constructed as stated above. The tips of the writing elements can be selectively projected and retracted from the top opening or front of the front barrel section by rotation of the cylindrical cam member against the front barrel section. When the mechanical pencil is selected for use, the pencil lead is discharged by knocking (depressing) the rear end of the eraser guide member, and the eraser can be projected and retracted as required.

DESCRIPTION OF THE PREFERRED EMBODIMENTS

Embodiments of the present invention will be described in detail hereinafter with reference to the accompanying drawings.

Now, a first embodiment will be detailed.

Figure 1:
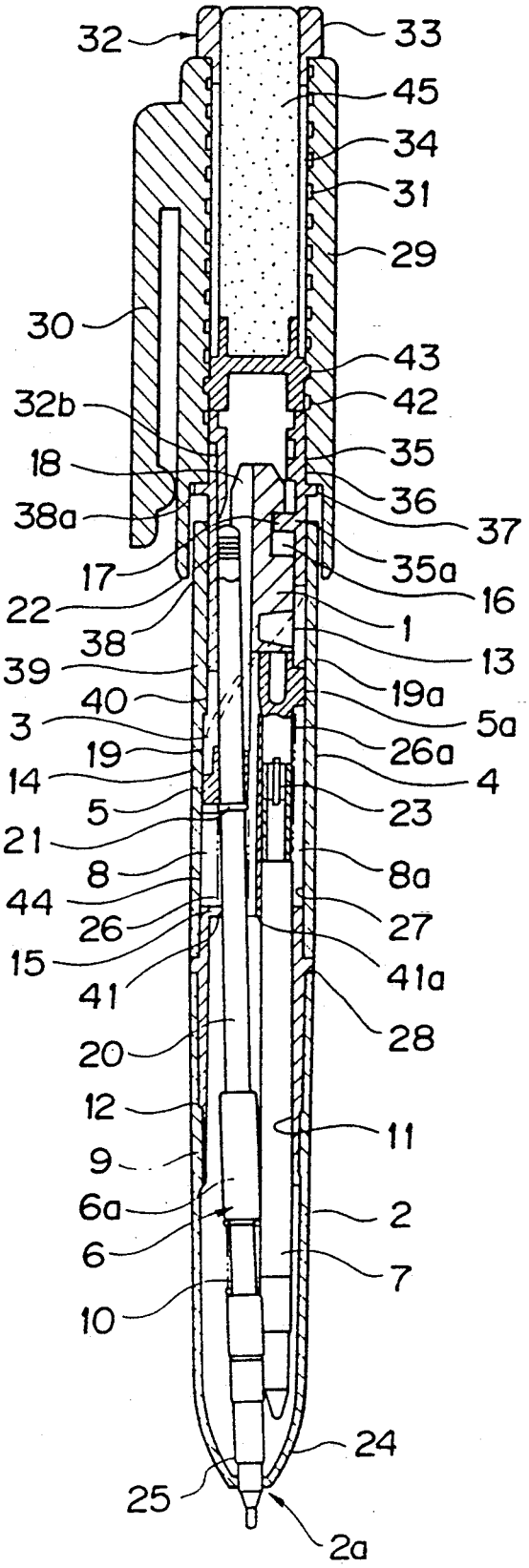
FIG. 1 is a longitudinal section showing an overall configuration of a multiplex writing implement of a first embodiment of the present invention.

FIG. 1 is a longitudinal section showing an overall configuration of a multiplex writing implement of a first embodiment.

As shown in FIG. 1, the multiplex writing implement includes as its main parts a guide cylinder 1, a front barrel section or member 2, a cylindrical cam 3, a middle barrel or member 4, a pair of sliding pieces 5, 5*a*, a mechanical pencil writing element 6, a writing element 7 of a ballpoint pen etc., a cap 29, an eraser guide cylinder, sleeve or member 32, an eraser holder 42 and an eraser 45.

Figure 2:
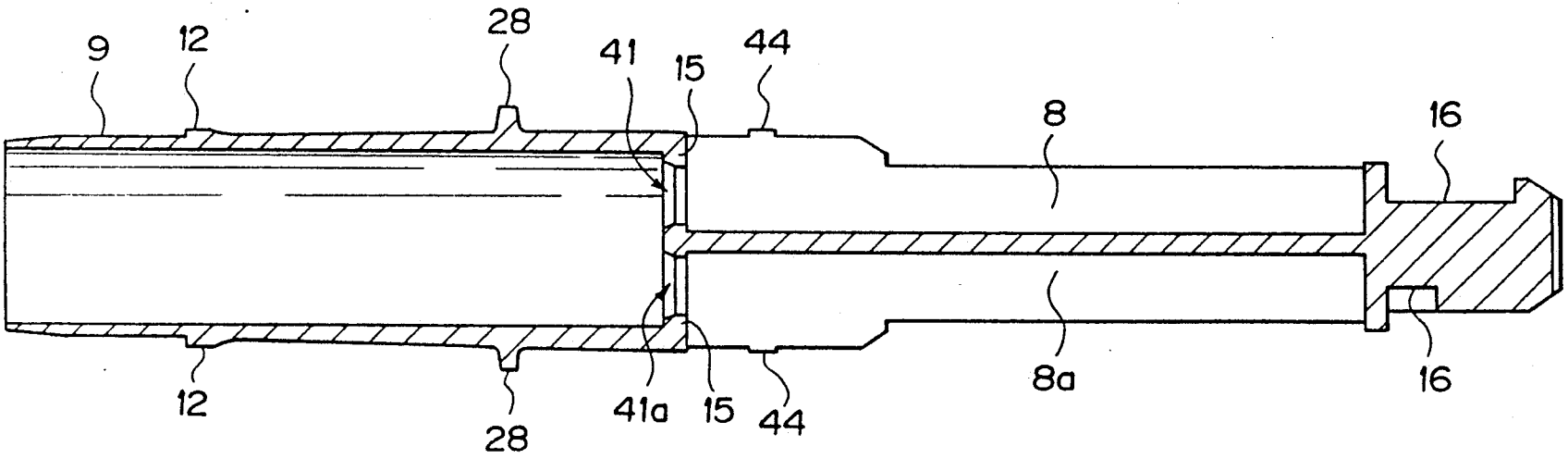
FIG. 2 is an illustration showing a cross-sectional structure of a guide cylinder of the same multiplex writing implement shown in FIG. 1.

FIG. 2 is sectional view of the guide cylinder or member 1. The guide cylinder 1 is made of a resin material, and has a first guide groove 8 opened in its one side and elongated in an axial direction from the approximately center portion to the rear end thereof, and a second guide groove 8*a* opened on the opposite side of the aforementioned side and elongated from the center portion to a position slightly inside the rear end.

The front half portion of the guide cylinder 1 is constructed by a tubular portion 9 of substantially cylindrical shape having an open front end and integrated with a partition member 15 in which two holes 41 and 41*a* are formed to communicate respectively with the guide grooves 8 and 8*a* stated above. The tubular portion 9 has a flange 28 projected outward on its circumference in the vicinity of the rear end thereof, and an engaging portion 12 slightly projecting (or swelling) outward on its circumference in the frontward side of the flange 28.

The guide cylinder 1 is formed on its cylindrical side slightly behind the tubular portion 9 with an engaging portion 44 slightly projecting (or swelling). This engaging portion serves to mate with an engaging groove 27 (which will be detailed hereinafter) of the middle barrel section 4.

The guide cylinder 1 also has a circumferential groove 16, more specifically, a groove which is formed along the circular direction on the side of the rear end.

The front barrel section 2 is made of a resin material, and as shown in FIG. 1, has a substantially cylindrical shape with the front end tapered to a point, while both the front and rear ends are opened.

The front barrel section 2 has an integral step portion 24 at the front end of the inner hollow thereof and a top opening 2*a* opened frontward ahead of the internal step portion 24.

On the inner wall slightly rearward from the center portion of the front barrel section 2, there is provided an engaging groove 11 which will mate with the engaging portion 12 of the tubular portion 9 of the guide cylinder 1. The engaging groove 11 meshes with the engaging portion 12 when the guide cylinder 1 (more specifically the tubular portion 9) is inserted into the front barrel section 2. The connection between the engaging groove 11 and engaging portion 12 does not allow the guide cylinder 1 to be drawn out from or rotated against the front barrel section 2. It should be noted that the tubular portion 9 is fixed so as to be attached to and detached from the front barrel section 2 only with an appropriate force.

Figure 3:
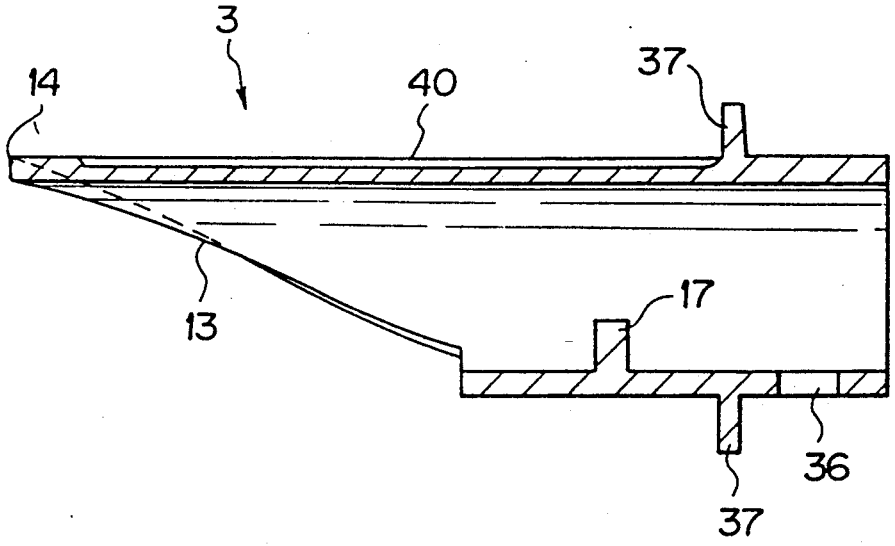
FIG. 3 is an illustration showing in a longitudinal section a structure of a cylindrical cam of the same multiplex writing implement shown in FIG. 1.
Figure 4:
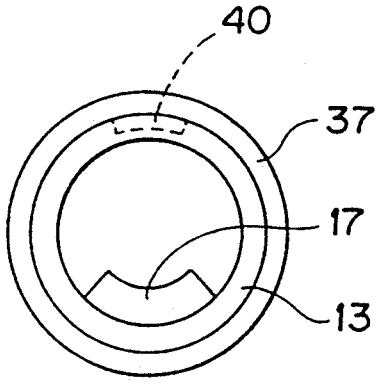
FIG. 4 is an illustration showing in a transversal section a structure of a cylindrical cam of the same multiplex writing implement shown in FIG. 1.

FIGS. 3 and 4 are longitudinal and transversal sections of the cylindrical cam 3.

As shown in FIGS. 1, 3 and 4, the cylindrical cam 3, made of a resin material, has a substantially cylindrical shape with a front end diagonally cut so as to make a slanted cam surface 13 which varies front to rear along the circle of the cut face. At the frontmost part of the slanted cam surface 13 is formed a cutout 14. On the outer side of the cylindrical cam 3, there is a groove 40 along the axial direction, into which a rib 39 (will be referred to hereinafter) on the middle barrel section 4 will be fit. Away from the cam surface 13, on the inner wall of the cylindrical cam 3 a collar portion 17 is provided having an approximately sectorial shape. The cylindrical cam 3 has a window 36 perforated on the wall thereof at a position closer to the rear end than the aforesaid collar portion 17.

Figure 5:
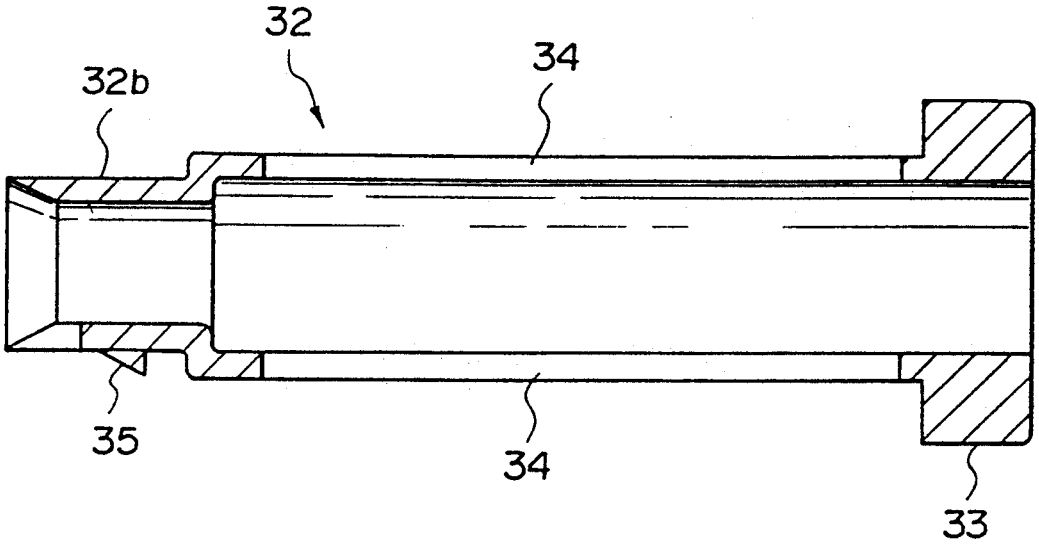
FIG. 5 is an illustration showing in a longitudinal section a structure of an eraser guide cylinder of the same multiplex writing implement shown in FIG. 1.
Figure 6:
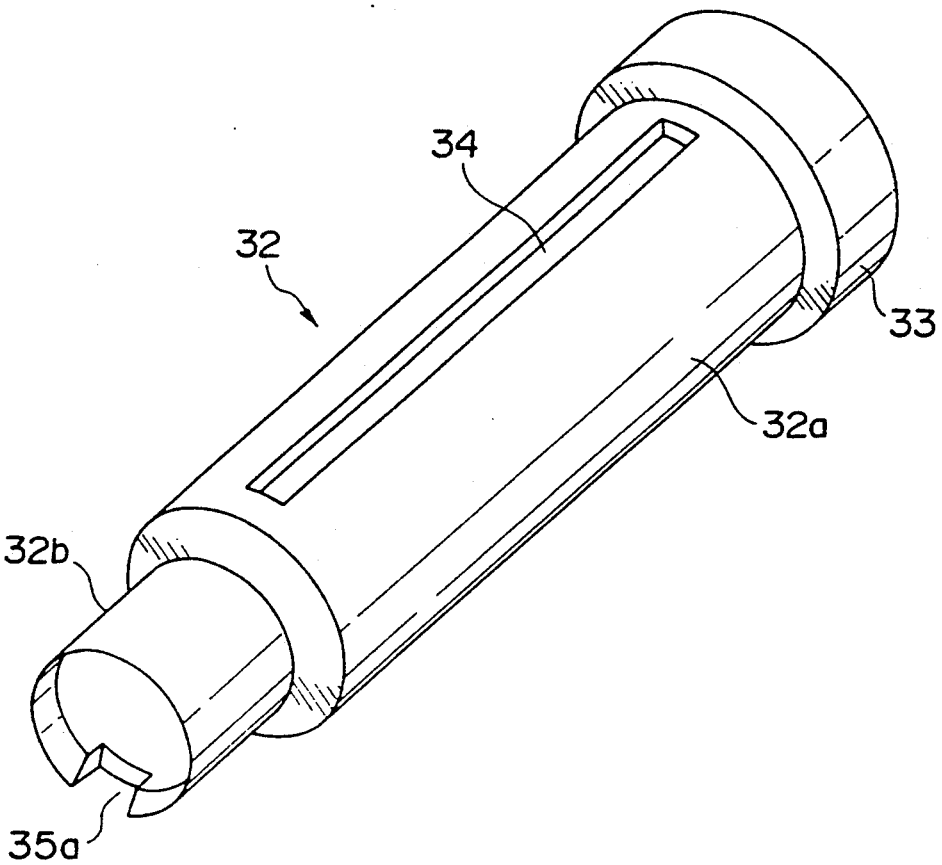
FIG. 6 is an illustration showing in perspective view a structure of an eraser guide cylinder of the same multiplex writing implement shown in FIG. 1.

FIGS. 5 and 6 are longitudinal and perspective views of the eraser guide sleeve 32, respectively.

As shown in FIGS. 1, 5 and 6, the eraser guide sleeve or member 32 includes a crown shaped portion 33 with a hollow bore at a rear side thereof for receiving an eraser 45, and a tubular portion (the central portion thereof) 32*a* extending frontward, which has elongated slits 34 each of which is perforated from the outer side to the inner side and extends in the axial direction. The eraser guide sleeve 32 has a small tubular portion 32*b* at its front end, which is to be fit in the rear end opening of the cylindrical cam 3. The small tubular portion 32*b* is equipped on the outer side thereof with a projection 35 which will engage with the window 36 of the cylindrical cam 3. In addition, the small tubular portion 32*b* has at its front end a recessed cutout 35*a* to engage with the collar portion 17 of the cylindrical cam 3 for avoiding rotation thereof.

The middle barrel section 4 mentioned above is formed with an annular engaging groove 27 near the front end on the inside wall thereof, and has an elongated rib 39 in the axial direction projecting inwardly from the inside wall near the rear end thereof. The rib 39 is to be fit in the groove 40 of the cylindrical cam 3 such that the former can move along the latter in the axial direction. As a result the cylindrical cam 3 and the middle barrel section 4 are fixed relative to each other with respect to the turning direction and are movable relative to each other in the axial direction.

The mechanical pencil 6 is to be inserted into the sliding piece 5, which has a projection 19 outwardly disposed thereon. The rear side of the projection 19 has a projection at the center thereof while both sides of the projection formed into a slanted cam surface having approximately the same gradient with that of the slanted cam surface 13 of the aforementioned cylindrical cam 3. The sliding piece 5 has a hole through which a pencil lead container pipe 20 is passed, extending rearward, while a flange portion 21 of the pencil lead container pipe 20 abuts against the front side of the hole.

The other sliding piece 5*a* is to contain a writing element 7 of a ballpoint pen etc., and has a projection 19*a* and a slanted cam surface like the sliding piece 5, and is provided at its front side with an engaging part 23 for catching the rear end of the writing element 7 of a ballpoint pen etc. Here, it is also possible that the engaging part 23 can be formed with a tubular structure which is used to cover and receive the rear end of the writing element.

The cap 29 is made of a resin material, and has at its front end a bore 38 to cover, and fit with the periphery of the rear end of the middle barrel section 4. The bore 38 is properly extended rearward and terminated by a step portion 38*a* raised inward. A slide bore, having a smaller diameter than that of the bore 38, is formed backward of the step portion 38*a* and extends to the rear end of the cap 29. The slide bore is to receive the eraser guide sleeve 32 and has a spiral slot 31 formed on the inner wall thereof. The cap 29 includes a clip 30 at the rear end on its outer side.

The eraser holder 42 has a bottomed bore having an opening at its rear end (the rear portion when the writing tip portion is taken as the front), to allow reception of the rear end (the front portion when the writing tip portion is defined as the front) of the eraser 45. The eraser holder 42 has projections 43 jutting outward from its peripheral portion at appropriate positions of the front end. The projections 43 are adapted to fit through the slits 34 of the eraser guide sleeve 32 and be accepted by the spiral slot 31 of the cap 29.

The mechanical pencil writing element 6 is composed of, mainly a chuck portion, a joint 6*a* and the pencil lead container pipe 20. The chuck portion has a step portion 25 at its front end, and is incorporated with a generally known chuck mechanism. The chuck mechanism of the chuck portion is joined at the rear end thereof with the joint 6*a* which in turn is connected to the pencil lead container pipe 20. The lead container pipe 20 has a flange 21 formed at the rear end thereof, and is inserted in the sliding piece 5, penetrating through the sliding piece 5 while the flange 21 abuts against the front side of the sliding piece 5. The rear opening of the lead container pipe 20 is closed with a rear cap 22 or other means.

A pencil lead of the mechanical pencil writing element 6 is discharged sliding along the chuck by the shift of the sliding piece 5 in the axial direction in a state where the top step portion 25 of the mechanical pencil writing element 6 is abutted against the internal step portion 24 of the front barrel section 2.

The mechanical pencil writing element 6 and the writing element 7 of a ballpoint pen etc. are caught by the sliding pieces 5 and 5*a* respectively at the rear side or rear end, and are fit in the respective guide grooves 8 and 8*a* in a movable manner. In addition, return springs 26, 26*a* are disposed between the front faces of the sliding pieces 5, 5*a* and the partition 15 at the end of the guide grooves 8, 8*a* so as to press the respective elements 6 and 7 rearward.

The collar portion 17 of the cylindrical cam 3 is resiliently fit into the circumferential groove 16 of the guide cylinder 1 so that the cylindrical cam 3 is attached to the guide cylinder 1 rotatable in the turning direction and locked in the axial direction.

The dimension of the circumferential groove 16 and the collar portion 17 is set up generally such that the cylindrical cam 3 is locked in the turning direction in a state where each of the writing elements 6 and 7 is projected out from the top opening of the front barrel section. The size of the circumferential groove 16 facing the collar portion 17 is determined such that in a state where the mechanical pencil writing element 6 is projected out, the width is equivalent to the stroke length needed for discharging the pencil lead. The slanted cam surfaces of the projections 19 and 19*a* are at all times kept in contact with the slanted cam surface 13 of the cylindrical cam 3 since the sliding pieces 5 and 5*a* are biased rearward by means of the return springs 26 and 26*a*, respectively.

The middle barrel section 4 is attached to the guide cylinder 1 and the cylindrical cam 3 so as to contain and cover these elements. In this case, the rear face of the flange 28 of the guide cylinder 1 abuts against the front face of the middle barrel section 4 whereas the engaging portion 44 of the guide cylinder 1 resiliently fits in and mates with the engaging groove 27 of the middle barrel section 4. Thus, the guide cylinder 1 is rotatable against the middle barrel section 4. The groove of the cylindrical cam 3 is fit in with the rib 39 of the middle barrel section 4, so that the cylindrical cam 3 is locked in the turning direction and movable in the axial direction with respect to the middle barrel section 4.

The tubular portion 9 of the guide cylinder 1 is fit in the front barrel section 2 with the front face of the flange 28 abutting against the rear face of the front barrel section 2 while the engaging portion 12 of the tubular portion 9 resiliently meshes with the engaging groove 11 of the front barrel section 2. As a result the front barrel section 2 is fixed, locked in both the turning direction and the axial direction, to the guide cylinder 1. Here, the front barrel section 2 is able to be attached to and detached from the tubular portion 9 of the guide cylinder 1 by an appropriate force.

In this arrangement, the middle barrel section 4 is rotated in one direction relative to the front barrel section 2, and the sliding piece 5, for example, advances to cause the projection 19 thereof to engage with the cutout 14 in the front end of the slanted cam surface 13 of the cylindrical cam 3. Thus, the writing tip of the mechanical pencil writing elements 6 is projected from the top opening 2*a* of the front barrel section 2. On the other hand, when the middle barrel section 4 is rotated with respect to the front barrel section in the other direction, the aforementioned sliding piece 5 is drawn back to retract the writing tip of the mechanical pencil writing element 6 from the top or front opening 2*a* of the front barrel section 2. Then, in the same manner as the sliding piece 5 advances, the other sliding piece 5*a* advances to allow the writing tip of the writing element 7 of a ballpoint pen etc. to project out of the top opening 2*a* of the front barrel section 2.

Meanwhile the eraser holder 42 is fit in the eraser guide sleeve 32. In this case, the slit 34 of the eraser sleeve 32 is spread out and through which the eraser holder 42 is resiliently inserted into the eraser sleeve 32. In addition, each projection 43 of the eraser holder 42 is fit in the slit 34 so that the eraser holder 42 is locked in the turning direction and slidable along the axial direction of the eraser guide sleeve 32.

The eraser guide sleeve 32 is fit in the cap 29 with the front step of the crown shaped portion 33 abutting against the rear end of the cap 29, while the projection 43 of the eraser holder 42 is engaged in the spiral slot 31 of the cap 29.

The eraser guide sleeve 32 has the small tubular portion 32*b* in the front end thereof, which portion is fit into the rear end bore of the cylindrical cam 3. At this time, the aforementioned projection 35 is meshed with the window 36, and the recessed cutout 35*a* is engaged with the collar portion 17, and thus the eraser guide sleeve 32 is connected with the cylindrical cam 3. In this case, a collar 37 around the rear end of the cylindrical cam 3 abuts against the step portion 38*a* (which is formed at the rear end of the bore 38 of the cap 29), while the rear end face (top end face in FIG. 1) of the cap 29 abuts against the front face of the crown shaped portion 33, so that the cap 29 is rotatable with respect to the eraser guide sleeve 32, and locked in the axial direction. The eraser 45 is inserted through the opening portion of the crown shaped portion 33 so that the rear end (front side with respect to the direction of the tip) of the eraser 45 fits in the eraser holder 42. With this, when the cap 29 is rotated with respect to the cylindrical cam 3, the eraser 45 is moved in and out from the opening of the crown shaped portion 33. Here, the inner diameter of the opening portion of the crown portion 33 is formed slightly larger than the outer diameter of the eraser 45.

Next will be an explanation of the operation of the first embodiment.

With the rotation of the middle barrel section 4 relative to the front barrel section 2, the cutout 14 arranged at the front end of the slanted cam surface 13 of the cylindrical cam 3, as shown in FIG. 1, engages with the sliding piece 5 of the mechanical pencil writing element 6, which causes the writing tip of the mechanical pencil writing element 6 to project out from the top or front end opening 2*a* of the front barrel section 2. At this time, the collar portion 17 of the cylindrical cam 3 is located in the wider portion of the circumferential groove 16. In this state, when the cylindrical cam 3 is shifted by knocking (depressing) the rear end of the crown shaped portion 33, in the axial direction with a stroke between the rear end of the middle barrel section 4 and the projection 37 of the cylindrical cam 3, the movement of the cylindrical cam 3 is transmitted to the sliding piece 5, the pencil lead container pipe 20 and the mechanical pencil writing element 6. In this state, the step portion 25 of the writing tip is abutted against the inner step 24 of the front barrel section 2, and with the transmission, the chuck is shifted together with the joint 6*a* in the axial direction to deliver the pencil lead. When the middle barrel section 4 is rotated about the front barrel section 2 in the other direction, the mechanical pencil writing element 6 is retracted and alternatively the writing tip of the writing element 7 of a ballpoint pen etc. is projected out from the top or front end opening 2*a* of the front barrel section 2.

Next, when the cap 29 is rotated in one direction with respect to the middle barrel section 4, the projection 43 of the eraser holder 42 is shifted backward to advance the eraser 45 from the opening portion of the crown shaped portion 33. In contrast, with the rotation of the cap 29 in the other direction, the eraser holder 42 is moved frontward, whereby the eraser 45 is retracted from the opening portion of the crown shaped portion 33.

As detailed heretofore, according to the first embodiment of the invention, the front barrel section, guide cylinder, middle barrel section, cylindrical cam, eraser, guide member and cap are resin molded articles, and each engaging portion of the guide cylinder, and the front and middle barrel sections are integrally provided. In addition, to the rear end of the cylindrical cam is integrally fixed the eraser guide sleeve. The eraser holder fits in the slits of the guide sleeve to which the cap having an spiral slot on the inner side thereof is attached. With this arrangement, the components which used to be made with metals in a conventional multiplex writing implement are replaced as a whole with resin material. Further, the number of components can be reduced, hence the assembling step is simplified, so that the cost of production can be lowered. Moreover, the eraser can be projected and retracted by the relative rotation between the middle barrel section and the cap, and the cap which is attached at the rear end of the middle barrel section is made long, in the axial direction, so as to allow the fingers to grasp it easily. As a result, delivery (exposure) of the eraser can be facilitated thus improving the handling of the implement.

Next, a second embodiment will be detailed.

Figure 7:
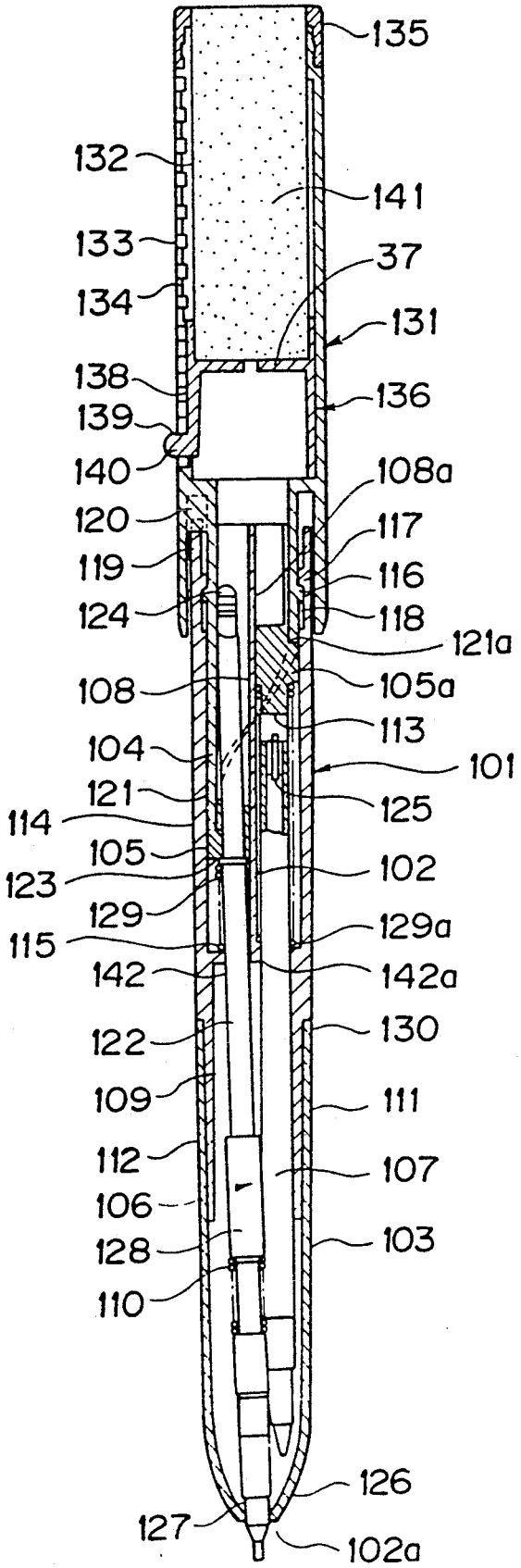
FIG. 7 is a longitudinal section showing an overall configuration of a multiplex writing implement of a second embodiment of the present invention.

FIG. 7 is a longitudinal section showing an overall configuration of a multiplex writing implement of a second embodiment.

As shown in FIG. 7, the multiplex writing implement in accordance with the second embodiment, includes as its main parts a middle barrel section 101 equipped integrally with a guide portion 102, a front barrel section 103, a cap 131 equipped integrally with a cylindrical cam 104, a pair of sliding pieces 105, 105*a*, a mechanical pencil writing element 106, a writing element 107 of a ballpoint pen etc., an eraser holder 136 and an eraser 141.

The middle barrel section 101, is made of a resin material, and as shown in FIG. 7, has a first guide groove 108 opened on one side and elongated in an axial direction from the approximately center portion to the rear end thereof, and a second guide groove 108*a* similar to the first guide groove 108 disposed on the opposite side of the aforementioned side.

The front half portion of the guide portion 102 includes a tubular portion 109 of substantially cylindrical shape having an open front end and connects with a partition member 115 in which two holes 142 and 142*a* are formed to communicate respectively with the guide grooves 108 and 108*a* stated above. The tubular portion 109 has a step portion 130 projected outward on its circumference in the vicinity of the rear end thereof, and an engaging portion 112 slightly projecting (or swelling) outward on its circumference in the frontward side of the step portion 130.

The middle barrel section 101 has a rear bore 108 opened at its rear end. On the internal wall near the rear bore is formed a partial or annular projection 117, whereas at the rear end is a wall 119 which defines the moving range of the cylindrical cam 104 (which will be described later).

The front barrel section 103 is made of a resin material, and as shown in FIG. 7, has a substantially cylindrical shape with the front end tapered to a point, while both the front and rear ends are open.

The front barrel section 103 has an internal step or sloped portion 126 at the front end of the inner hollow thereof and a top or front end opening 102*a* opened frontward of the internal step portion 126.

On the inner wall slightly rearward from the center portion of the front barrel section 103, there is provided an engaging groove 111 which will mate with the engaging portion 112 of the tubular portion 109 of the guide portion 102. The engaging groove 111 meshes with the engaging portion 112 when the guide portion 102 (more specifically the tubular portion 109) is inserted into the front barrel section 103. The combination between the engaging groove 111 and engaging portion 112 does not allow the guide portion 102 to be drawn out from, and to turn with respect to, the front barrel section 103. It should be noted that the tubular portion 109 is fixed so as to be attached to and detached from the front barrel section 103 with an appropriate force.

The cap 131 is made of a resin material, and as shown in FIG. 7, has the aforementioned cylindrical cam 104 integrated at the front end thereof. The cylindrical cam 104, as shown in FIG. 7, has a substantially cylindrical shape with a front end diagonally cut so as to make a slanted cam surface 113 which varies front to rear along the circle of the cut face. At the frontmost part of the slanted cam surface 113 is formed a cutout 114. On the outer side of the cylindrical cam 104, there is formed a partial or annular projection 116 which resiliently passes over the projection 117 of the middle barrel section 101 to prevent the cylindrical cam 104 from being drawn out from the middle barrel section 101. In addition, the cylindrical cam 104 is provided with a rib 120 which bears the wall 119 of the middle barrel section at the rear end thereof and restricts the rotational movement of the cylindrical cam 104 within an angle of about 180 degrees.

Meanwhile, the aforementioned cap 131 has a tubular portion extending backward of the cylindrical cam 104. On the side of the tubular portion, there is provided a slit 132 perforated and elongated in the axial direction. In addition, projections 133 and slots 134 are alternately arranged on both side of the slit 132.

Inside the tubular portion of the cap 131 is attached an eraser holder 136 having an eraser 141 fixed at its rear end and being slidable in the axial direction.

In this case, the eraser holder 136, having an engaging projection 139 on the peripheral side thereof, is attached to the cap 131 such that the engaging projection 139 can be engaged with and disengaged from the slot 134 of the slit 132.

The engaging projection 139 is formed at the front end of a resilient piece 138 disposed on the side of the eraser holder 136, and keeps the eraser 141 extended by engaging with the slot 134 while being displaced elastically with slide of the eraser holder 136. Further the engaging projection 139 has an operative projection 140 jutting slightly out at the center thereof. The eraser holder 136 can be moved forward or backward while the operative projection 140 is being pressed to release the engaging projection 139 from the slot 134.

At the rear end of the tubular portion stated above is disposed a crown top 135 which covers the circular rear end of the cap 131.

The mechanical pencil 106 is to be inserted into the sliding piece 105, which has a projection 119 outwardly disposed thereon. The rear side of the projection 119 has a projection at the center thereof. Both sides of the projection are formed into a slanted cam surface having approximately the same gradient as that of the slanted cam surface 113 of the aforementioned cylindrical cam 104. The sliding piece 105 has a hole through which a pencil lead container pipe 122 is passed, extending rearward while a flange portion 123 of the lead container pipe 122 abuts against the front side of the sliding piece 105.

The other sliding piece 105*a* is to be inserted with a writing element 107 of a ballpoint pen etc., and has a projection 121*a* and a slanted cam surface like the sliding piece 105, and is provided at its front side with an engaging portion 125 for catching the rear end of the writing element 107 of a ballpoint pen and the like. Here, it is also possible that the engaging part 125 can be made as a tubular structure which is used to cover and receive the rear end of the writing element.

The mechanical pencil writing element 106 is composed of, mainly a chuck portion, joint 128 and the pencil lead container pipe 122. The chuck portion has a step portion 127 at its front end, and includes a generally known chuck mechanism. The chuck mechanism at the rear end of the chuck portion is connected through the joint 128 with the lead container pipe 122. The pencil lead container pipe 122 has a flange 123 formed near the rearward end thereof, and inserted in the sliding piece 105, penetrating through the sliding piece while the flange 123 abuts against the front side of the sliding piece 105. The rear opening of the lead container pipe 122 is closed with a rear cap 124 or other means.

A pencil lead of the mechanical pencil writing element 106 is slidingly discharged along the chuck by the shift of the sliding piece 105 in the axial direction in a state where the top step portion 127 of the mechanical pencil writing element 106 is abutted against the internal step portion 126 of the front barrel section 103.

The mechanical pencil writing element 106 and the writing element 107 of a ballpoint pen etc. are caught by the sliding pieces 105 and 105*a* respectively at the rear side or rear end, and are fit in the respective guide grooves 108 and 108*a* in a movable manner. In addition, return springs 129, 129*a* are disposed between the front faces of the sliding pieces 105, 105*a* and the partition 115 at the end of the guide grooves 108, 108*a* so as to press the respective elements 106 and 107 rearward.

With regard to attachment of the cap 131, the cylindrical cam 104, which is integrated with the cap 131, is elastically fit into a rear end bore 118 of the middle barrel section 101, so that the cap 131 may be attached for rotation 180 degrees in a circular direction with respect to the middle barrel section 101 and may not be drawn out.

While the mechanical pencil writing element 106 is being projected, the cap 131 can be moved relative to the middle barrel section 101 in the axial direction by a necessary stroke length for delivering a pencil lead. On the other hand, when the mechanical pencil writing element 106 is retracted or the writing element 107 of a ballpoint pen etc. is projected, the rib 120 abuts against the rear end of the middle barrel section 101 and consequently the cap 131 will not move in the axial direction.

The slanted cam surfaces of the projections 121 and 121*a* are always kept in contact with the slanted cam surface 113 of the cylindrical cam 104 since the sliding pieces 105 and 105*a* are biased rearward by means of the return springs 129 and 129*a*, respectively.

The tubular portion 109 of the middle barrel section 101 is inserted into the front barrel section 103 with the front face of the step portion 130 of the middle barrel section abutting against the rear face of the front barrel section 103, while the engaging portion 112 of the tubular portion 109 fits resiliently with the engaging groove 111 of the front barrel section 103. As a result the front barrel section 103 is fixed in both the turning direction and in the axial direction against the middle barrel section 101. Here, the front barrel section 103 is able to be attached to and detached from the tubular portion 109 of the middle barrel section 101 with an appropriate force.

In this arrangement, when the cap 131 is rotated in one direction relative to the front barrel section 103 or the middle barrel section 101, the sliding piece 105, for example, advances to cause the projection 121 thereof to engage with the cutout 114 in the front edge of the slanted cam surface 113 of the cylindrical cam 104. Thus, the writing tip of the mechanical pencil writing element 106 is projected from the top opening of the front barrel section 103. On the other hand, when the cap 131 is rotated in the other direction against the front barrel section 103 or the middle barrel section 101, the aforementioned sliding piece 105 is drawn back to retract the writing tip of the mechanical pencil writing element 106 from the top or front opening of the front barrel section 103. Then in the same manner as the sliding piece 105 advances, the other sliding piece 105*a* advances to allow the writing tip of the writing element 107 of a ballpoint pen etc. to project out of the top opening of the front barrel section 103.

Meanwhile, the eraser holder 136 is inserted from the rear end of the tubular portion of the cap 131. In this case, the projection 139 of the eraser holder 136 is fit in the groove 134 of the slit 132 disposed in the tubular portion so that the eraser holder 136 is slidable with respect to the tubular portion. A crown 135 is adhesively fixed at the rear end of the tubular portion. Then the eraser 141 is inserted through the opening at the rear end of the crown 135 with the rear end (frontward with respect to the writing tip) of the eraser 141 abutted against the eraser holder 136.

With this configuration as stated above, when the eraser holder 136 is moved forward and backward, the eraser 141 is projected and retracted from the opening of the crown 135. Here the inner diameter of the opening portion of the crown 135 is slightly larger than the outer diameter of the eraser 141.

Following is an explanation of the operation of the second embodiment.

With the rotation of the cap 131 relative to the front barrel section 103 or the middle barrel section 101, the cutout 114 at the front end of the slanted cam surface 113 of the cylindrical cam 104, as shown in FIG. 7, engages with the sliding piece 105 of the mechanical pencil writing element 106, which causes the writing tip of the mechanical pencil writing element 106 to project out from the top or front opening 102*a* of the front barrel section 106. At this time, the rib 120 of the cap 131 abuts against the wall 119 at the rear end of the middle barrel section 101. In this state, when the crown 135 is shifted in the axial direction by knocking (depressing) the rear end thereof, the movement is transmitted to the sliding piece 105, the pencil lead container pipe 122 and the mechanical pencil writing element 106. In this state, the step portion 127 of the tip of the writing element is abutted against the inner step 126 of the front barrel portion 106, and with the transmission, the joint 128 and the chuck are shifted in the axial direction to deliver the lead. When the cap 131 is rotated in the other direction relative to the front barrel section 103 or the middle barrel section 101, the mechanical pencil writing element 106 is retracted and alternatively the writing tip of the writing element 107 of a ballpoint pen etc. is projected out from the top opening of the front barrel section 103.

Next, when the operative projection 140 of the eraser holder 136 is moved rearward in the axial direction with respect to the cap 131 while being pressed, the engaging projection 139 is released from the slot 134 of the slit 132, and the eraser holder 136 may be gradually moved rearward to extend the eraser 141 from the opening of the crown 135. On the other hand, if the operative projection 140 is moved frontward in the axial direction while pressed, the eraser holder 136 moves frontward to retract the eraser 141 from the opening of the crown 135.

As detailed heretofore, according to the second embodiment of the invention, the front barrel section 103, the middle barrel section 101 which connects with the guide portion 102, and the cap 131 which connects with the cylindrical cam 104 are made as resin molded articles, and each of the engaging portions for joining the middle barrel section 101 with the front barrel section 103 and with the cap 131 is provided integrally in the corresponding sections. In addition, the tubular portion at the rear of the cap 131 is provided with the slit 132 having projections 133 and slots 134 alternately so that the projection 139 of the eraser holder 136, inserted in the tubular portion, is engaged with the slots 134 of the slit 132.

With this arrangement, the components which used to be made with metals in a conventional multiplex writing implement are replaced as a whole with resin components. Further, the number of the components can be reduced, hence the assembling step is simplified, so that the cost of production can be lowered, thus making it possible to provide products at low cost. Moreover, since an operative projection is provided which is movable backward and forward, the eraser can be easily extended and retracted thereby providing convenient handling. Particularly, for the operation to extend the eraser, the multiplex writing implement of the first embodiment requires both hands to rotate the cap, that is, the rotation is carried out by grasping the front barrel section with one hand and the cap with the other. In contrast with this, according to the multiplex writing implement of the second embodiment, the operation of the eraser can be carried out effectively by a single hand, specifically by shifting the engaging projection with a thumb of a hand while the implement is being held by the same hand. As a result, the second embodiment is more convenient to operate.

I claim:

1. A multiplex writing implement comprising:

a front barrel section made of a resin and having a longitudinal axis;

a middle barrel section, made of a resin, and disposed coaxially with and in the rear of said front barrel section;

a plurality of writing elements, at least one of which is a mechanical pencil, and each of which is provided with a sliding piece at a rear end thereof;

a writing element guide member, made of a resin material, and fixed to said front barrel section for fitting each of said plural writing elements in a corresponding guide groove that is arranged in the axial direction so that the writing elements can be moved in the axial direction, said writing element guide member being axially non-rotatable and locked in the axial direction relative to said middle barrel section;

a cylindrical cam member having a slanted cam surface at a front side thereof, said cam surface being around a periphery of a guide cylinder, said slanted cam surface having a generally circular shape and being abutted against said sliding pieces;

an eraser holder having a projection integrally provided on a peripheral side thereof for fixing an eraser at a rear opening;

an eraser guide member fixedly disposed at a rear end of said cylindrical cam member so as to move integrally with said cylindrical cam member, said eraser guide member having an axial slit into which the projection of said eraser holder is slidably fit for allowing said eraser holder to slide in said slit;

an eraser projecting and retracting means for extending and retracting the eraser from a rear end of said eraser guide member by moving said eraser holder inside said eraser guide member;

said middle barrel section being locked against said cylindrical cam member to prevent rotation;

said cylindrical cam member being integrally and fixedly connected with said eraser guide member such that a front end portion of said eraser guide member joins with a rear end of said cylindrical cam member;

said eraser guide member carrying on its circumference a cap member which is made of a resin material with a spiral slot formed on an inner wall thereof, such that said cap member is rotatable but locked in the axial direction relative to said eraser guide member;

said eraser projecting and retracting means including said slit disposed in said eraser guide member, the spiral slot disposed on the inner wall of said cap member, and said eraser holder projection which is fit in the spiral slot through the slit; and said sliding pieces being biased to abut against the slanted cam surface of said cylindrical cam member and moved forward and backward alternately by rotation of said cylindrical cam member with respect to the front barrel section, each writing tip of the writing elements being selectively projected and retracted from a front opening of said front barrel section; and when the mechanical pencil writing element is selectively engaged, pencil lead can be discharged by depressing the rear end of said eraser guide member against the middle barrel section, and the eraser can be extended and retracted from the rear end of said eraser guide member of said multiplex writing implement by rotation of said cap member against said middle barrel section.

2. A multiplex writing implement comprising:

a front barrel section made of a resin and having a longitudinal axis;

a middle barrel section, made of a resin, and disposed coaxially with and in the rear of said front barrel section;

a plurality of writing elements, at least one of which is a mechanical pencil, and each of which is provided with a sliding piece at a rear end thereof;

a guide member, made of a resin material, and fixed to said front barrel section for receiving each of said plural writing elements in a corresponding guide groove that is arranged in the axial direction so that the writing elements can be moved in the axial direction, said middle barrel section being integrally connected with said guide member;

a cylindrical cam member having a slanted cam surface at a front side thereof, said cam surface being around a periphery of a guide cylinder, said slanted cam surface having a generally circular shape and being abutted against said sliding pieces;

an eraser holder having a projection integrally provided on a peripheral side thereof for fixing an eraser at a rear opening;

an eraser guide member fixedly disposed at a rear end of said cylindrical cam member so as to move integrally with said cylindrical cam member, said eraser guide member having an axial slit into which the projection of said eraser holder is slidably fit for allowing said eraser holder to slide in said slit;

an eraser projecting and retracting means for extending and retracting the eraser from a rear end of said eraser guide member by moving said eraser holder inside said eraser guide member;

said eraser guide member and eraser holder having eraser engaging means for maintaining said eraser holder at a desired position;

said middle barrel section being locked against said cylindrical cam member to prevent rotation;

said cylindrical cam member being fixedly connected with said eraser guide member such that a front end portion of said eraser guide member joins with a rear end of said cylindrical cam member;

said eraser guide member carrying on its circumference a cap member which is made of a resin material and formed with a spiral slot on the inner wall thereof, such that said cap member is rotatable but locked in the axial direction relative to said eraser guide member;

said eraser projecting and retracting means including said slit disposed in said eraser guide member, the spiral slot disposed on the inner wall of said cap member, and said eraser holder projection which is fit in the spiral slot through the slit; and said sliding pieces being biased to abut against the slanted cam surface of said cylindrical cam member, and moved forward and backward alternately by rotation of said cylindrical cam member with respect to the front barrel section, each writing tip of the writing elements being selectively projected and retracted from a front opening of said front barrel section; and when the mechanical pencil writing element is selectively engaged, pencil lead can be discharged by depressing the rear end of said eraser guide member against the middle barrel section, and the eraser can be extended and retracted from the rear end of said eraser guide member of said multiplex writing implement by rotation of said cap member against said middle barrel section.

3. A multiplex writing implement comprising:

a front barrel section made of a resin having a longitudinal axis;

a middle barrel section, made of a resin, and disposed coaxially with and in the rear of said front barrel section;

a plurality of writing elements, at least one of which is a mechanical pencil, and each of which is provided with a sliding piece at a rear end thereof;

a guide member, made of a resin material, and fixed to said front barrel section for receiving each of said plural writing elements in a corresponding guide groove that is arranged in the axial direction so that the writing elements can be moved in the axial direction, said middle barrel section being integrally connected with said guide member;

a cylindrical cam member having a slanted cam surface at a front side thereof, said cam surface being around a periphery of a guide cylinder, said slanted cam surface having a generally circular shape and being abutted against said sliding pieces;

an eraser holder having a projection integrally provided on a peripheral side thereof for fixing an eraser at a rear opening;

an eraser guide member fixedly disposed at a rear end of said cylindrical cam member, said eraser guide member having an axial slit into which the projection of said eraser holder is slidably fit for allowing said eraser holder to slide in said guide member, edges of said slit having projected and recessed portions; and said eraser holder projection fitting into the slit to extend beyond an outer face of said eraser guide member, said projection being able to engage and disengage the recessed portions, whereby the eraser is projected and retracted from the rear end of said eraser guide member and maintained in a selected position;

said middle barrel section being locked against said cylindrical cam member to prevent rotation;

said cylindrical cam member being fixedly connected with said eraser guide member such that a front end portion of said eraser guide member joins with a rear end of said cylindrical cam member;

said sliding pieces being biased to abut against the slanted cam surface of said cylindrical cam member, and moved forward and backward alternately by rotation of said cylindrical cam member with respect to the front barrel section, each of the writing elements being selectively projected and retracted from a front opening of said front barrel section; and when the mechanical pencil writing element is selectively engaged, pencil lead can be discharged by depressing the rear end of said eraser guide member against the middle barrel section, and the eraser can be extended and retracted from the rear end of said eraser guide member of said multiplex writing implement by said slit recessed portions.

4. A multiplex writing implement according to claim 3, wherein the front end portion of said eraser guide member covers said guide member and the rear end of said middle barrel section.

* * * * *